US008649549B2

(12) United States Patent
Huang

(10) Patent No.: US 8,649,549 B2
(45) Date of Patent: Feb. 11, 2014

(54) SPEAKER

(75) Inventor: Jin-Quan Huang, Shenzhen (CN)

(73) Assignees: AAC Acoustic Technologies (Shenzhen) Co., Ltd., Shenzhen (CN); AAC Technologies Pte. Ltd., Singapore (SG)

( * ) Notice: Subject to any disclaimer, the term of this patent is extended or adjusted under 35 U.S.C. 154(b) by 75 days.

(21) Appl. No.: 12/978,589

(22) Filed: Dec. 26, 2010

(65) Prior Publication Data

US 2011/0293134 A1 Dec. 1, 2011

(30) Foreign Application Priority Data

May 25, 2010 (CN) ..... 2010 1 0182964

(51) Int. Cl.
*H04R 1/00* (2006.01)

(52) U.S. Cl.
USPC ..... 381/412

(58) Field of Classification Search
USPC ..... 381/400, 408, 409, 431, 398
See application file for complete search history.

(56) References Cited

U.S. PATENT DOCUMENTS 2,020,705 A * 11/1935 Stenger ..... 181/172
2005/0175205 A1* 8/2005 Takahashi ..... 381/336

* cited by examiner

*Primary Examiner* — Curtis Kuntz
*Assistant Examiner* — Sunita Joshi
(74) *Attorney, Agent, or Firm* — IPro, Inc.; Na Xu

(57) ABSTRACT

A speaker having a voice coil is disclosed. The voice coil includes two parallel main members and two linking members connecting the two main members for forming a closed loop, one of the linking member having at least a first part from a first circle having a first diameter, and at least a second part from a second circle having a second diameter greater than the first diameter.

6 Claims, 3 Drawing Sheets

SPEAKER

BACKGROUND OF THE INVENTION

1. Field of the Invention

The present invention generally relates to electro-magnetic transducers, and more particularly to a speaker having a voice coil.

2. Description of Related Art

In recent years, with the proliferation of slim-type electronic devices such as liquid crystal display devices, mobile telephones, there is a demand for thin-type and slim-type speakers with high performance. Generally, a speaker includes a magnetic circuit system for generating electromagnetic force to drive a coil thereof to vibrate. Typically, the magnetic circuit system includes a yoke, a magnet positioned on the yoke, and a top plate attached to the magnet. A magnetic gap is formed between the yoke and the magnet. If a coil is suspended in the magnetic gap, when electrified, the coil will be given a magnetizing force, and the force is determined by the product of magnetic flux B, displacement of the coil L, and current applied on the coil. Production of B and L is called magnetizing force factor.

A voice coil used in a related speaker comprises two parallel linear members, and two arc members connecting two ends of the linear members respectively. The linear members and the arc members define a closed loop, like a standard run track. The arc member is generally a half circle. A speaker with such a coil has low sensitivity because it increases the length of the voice coil but contributes little for sensitivity.

So, it is necessary to provide an improved voice coil and a speaker using the voice coil for solving the problems mentioned above.

Figure 1:
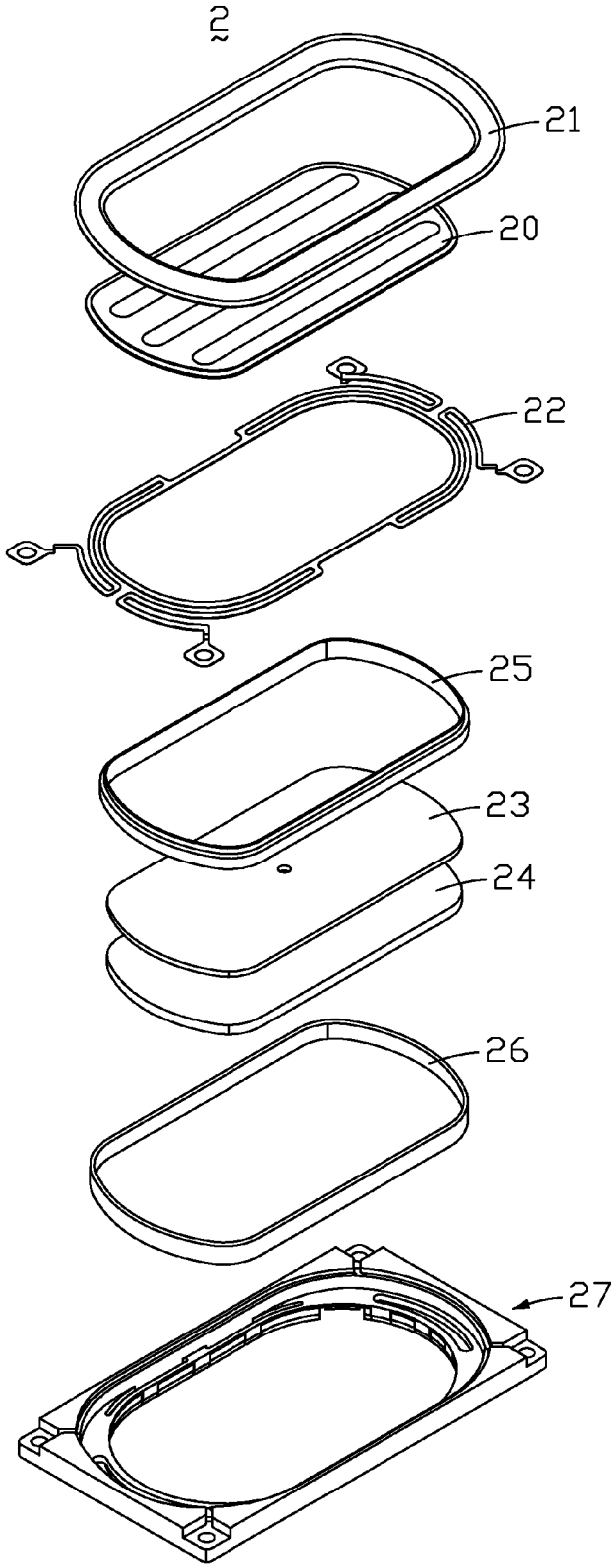
FIG. 1 is an exploded view of a speaker in accordance with one embodiment of the present invention.

Many aspects of the embodiments can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Reference will now be made to describe the exemplary embodiment of the present invention in detail.

Figure 2:
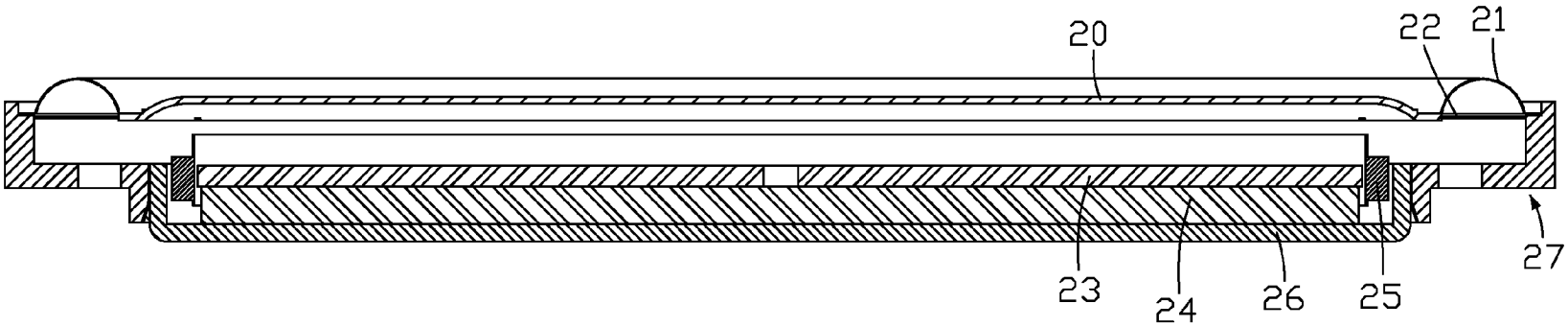
FIG. 2 is a cross-sectional view of the speaker in FIG. 1.

Referring to FIGS. 1-2, a speaker 2 comprises a case 27, a circuit board 22, a magnetic circuit and a vibrating device. The magnetic circuit comprises a magnetic bowl 26 coupled to the case 27, a magnet 24 positioned in the magnetic bowl 26, and a pole plate 23 covering the magnet 24. A magnetic gap is formed by the magnet 24 and the magnetic bowl 26. The vibrating device includes a diaphragm supported by the case 27 and vibrating along a vibrating direction and a voice coil 25 connected to the diaphragm. The diaphragm comprises a main body 20 and a margin 21 extending from the periphery of the main body 20 to a direction away from a centre of the main body 20. A plurality of ribs are arranged to be positioned on a surface of the main body 20. In the exemplary embodiment, the voice coil 25 is attached to the diaphragm by virtue of the circuit board 22. The circuit board 22 is used to electrically connect to leads of the voice coil and then connect to an external circuit. In fact, the circuit board 22 is optional, and without the circuit board 22, the voice coil 25 can be directly connected to a lower surface of the diaphragm and leads thereof can be directly connected to the external circuit. In addition, the circuit board 22 means a medium for connecting the voice coil to the external circuit, and it can be a printed circuit board, an elastic plate having conductive elements, or other member having conductive elements.

Figure 3:
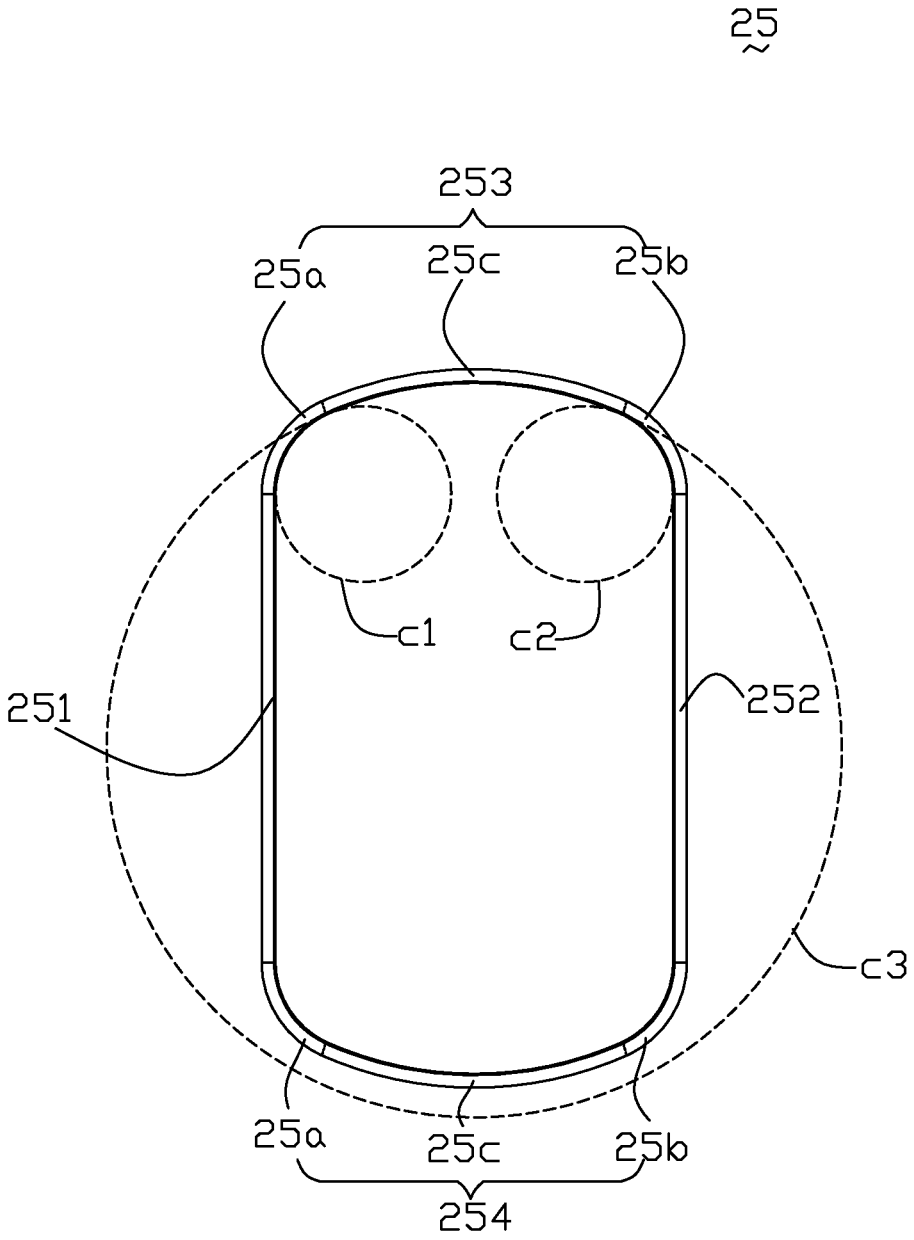
FIG. 3 is a top view of a voice coil used in the speaker of the present disclosure.

Referring to FIG. 3, the voice coil 25 comprises a first main member 251, a second main member 252 parallel to the first main member 251, a first linking member 253 connecting two ends of the first and second main members 251, 252 at a first side, and a second linking member 254 connecting another two ends of the first and second main members 251, 252 at a second side opposed to the first side. The first main member 251, the second main member 252, the first linking member 253 and the second linking member 254 define a closed loop together. The first linking member 253 defines a first arc 25*a* connecting to the first main body 251, a second arc 25*b* connecting to the second main body 252, and a third arc 25*c* connecting and located between the first arc 25*a* and the second arc 25*b*. A curvature radius of the first arc 25*a* or the second arc 25*b* is less than that of the third arc 25*c*. It is optional that the curvature radius of the first arc 25*a* is equal to that of the second arc 25*b*. Another word, the first linking member 253 has at least two different curvature radiuses. It is optional that the second linking member 254 has the same configuration to the first linking member 253. In order to achieve the configuration described above, as illustrated in FIG. 3, the first arc 25*a* is a part of a first circle C1 having a first diameter, the second arc 25*b* is a part of a second circle C2 having a second diameter equal to the first diameter, and the third arc 25*c* is a part of a third circle C3 having a third diameter greater than the first diameter.

As the linking member includes a portion having a greater curvature radius than the other portions, length of the voice coil is effectively reduced without affecting the sensitivity of the speaker. In addition, with a portion having a greater curvature radius than other portions, the voice coil is expanded along a radial direction, which enables the main body of the diaphragm to be enlarged. As a result, the acoustic performance of low frequency is accordingly improved.

While the present invention has been described with reference to specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A speaker comprising:

a magnetic circuit defining a magnetic gap;

a vibrating device having a voice coil and a diaphragm, the voice coil being partially received in the magnetic gap;

the voice coil comprising:

a first main member;

a second main member being parallel to the first main member;

a first linking member connecting two ends of the first and the second main members at a first side;

a second linking member connecting two ends of the first and the second main members at a second side opposed to the first side;

a closed loop formed by the first main member, the second main member, the first linking member and the second linking member; wherein the first linking member includes:

a first arc connecting to the first main body, the first arc being a part of a first circle having a first curvature radius;

a second arc connecting to the second main body, the second arc being a part of a second circle having a second curvature radius;

and a third arc located between the first arc and the second arc, the third arc being a part of a third circle having a third curvature radius greater than each of the first and second curvature radiuses.

2. The speaker as described in claim 1, wherein the first curvature radius is equal to the second curvature radius.

3. The speaker as described in claim 2, wherein the second linking member is configured to be the same to the first linking member.

4. A speaker comprising a voice coil, the voice coil comprising:

a first main member;

a second main member parallel to the first main member;

two linking members connecting ends of the first and second main members for forming a closed loop, at least one of the linking member including a first circular arc connecting to the first main member, a second circular arc connecting to the second main member, and a third circular arc connecting the first and second circular arcs, wherein each of the first and second circular arcs has a degree of curve higher than a degree of curve of the third circular arc.

5. The speaker as described in claim 4, wherein the first arc has a first curvature radius equal to a second curvature radius of the second arc.

6. The speaker as described in claim 5, wherein the two linking members include a first linking member and a second linking member configured to be the same to the first linking member.

* * * * *